US005275396A

United States Patent [19]

Sudia

[11] Patent Number: 5,275,396

[45] Date of Patent: Jan. 4, 1994

[54] PORTABLE BATTING PRACTICE MACHINE

[76] Inventor: Michael T. Sudia, 3491A Moraga Blvd., Lafayette, Calif. 94549

[21] Appl. No.: 977,602

[22] Filed: Nov. 17, 1992

Related U.S. Application Data

[63] Continuation-in-part of Ser. No. 844,118, Mar. 2, 1992, abandoned.

[51] Int. Cl.[5] ..... A63B 69/00

[52] U.S. Cl. ..... 273/26 E

[58] Field of Search ..... 273/26E; 242/67.2, 67.3

[56] References Cited

U.S. PATENT DOCUMENTS

| | | | |
|---|---|---|---|
| 3,333,847 | 8/1967 | Pennington | 273/267 E |
| 3,588,104 | 6/1971 | Griffin | 273/26 E |
| 3,637,208 | 1/1972 | Alfred | 273/26 E |
| 3,885,790 | 5/1975 | Parr | 273/26 E |
| 3,967,790 | 7/1976 | Hess | 242/67.2 |
| 4,905,926 | 3/1990 | Celeste | 242/67.2 |
| 5,018,729 | 5/1991 | Wilkerson | 273/26 E |

*Primary Examiner*—Theatrice Brown

*Attorney, Agent, or Firm*—Bruce H. Johnsonbaugh

[57] ABSTRACT

A batting practice apparatus is provided wherein a ball is swung around a generally circular path in a forward direction and a user periodically swings a bat or racket in an attempt to hit the ball in the opposite direction. A DC drive motor has a shaft connected to a horizontal arm for rotation in the forward direction, the shaft and arm will rotate in the opposite direction only when the ball is driven in the opposite direction by the user. Sensors are provided for detecting when the shaft is rotated in the opposite direction and by the user and for measuring the speed in the shaft when rotated in the opposite direction and a speech processor cooperates with the sensors for providing immediate audio feedback to the user.

3 Claims, 3 Drawing Sheets

PORTABLE BATTING PRACTICE MACHINE

CROSS-REFERENCE TO RELATED APPLICATIONS

This application is a continuation-in-part of application Ser. No. 07/844,118 filed Mar. 2, 1992 (now abandoned).

BRIEF SUMMARY OF THE INVENTION

The present invention provides a lightweight and portable batting practice apparatus which provides a wide variety of simulated pitches for presentment to a batter. The present invention may be utilized indoors. The present invention utilizes a DC motor in the drive mechanism in a manner to avoid the use of a clutch mechanism. This feature allows the rotating arm, which carries the ball, to be driven in a reverse direction. The present invention includes a sensing mechanism which measures the strength of the blow when a batter contacts the ball. The sensing mechanism interacts with a speech processor and speaker to immediately play an appropriate message to the user, such as "home run" when the batter strikes a solid blow or "foul tip" when the user delivers only a glancing blow to the rotating ball.

The present invention also provides a remote control unit whereby the user may vary the speed of rotation of the ball. A motor reverse switch is also provided which allows the machine to be used by lefthanders.

A primary object of the invention is to provide a lightweight and portable batting practice apparatus capable of being used indoors.

A further object of the invention is to provide a batting practice apparatus wherein a DC motor is used in the drive mechanism in a manner which avoids the use of clutch mechanisms or other cumbersome mechanisms to allow rotation of the drive mechanism in the reverse direction when the batter strikes the ball.

Another object of the invention is to provide a sensing mechanism and a speech processor wherein the sensing mechanism senses the strength of the blow and thereafter interacts with the speech processor to provide immediate audio feedback to the user after making contact with the ball.

Another object of the invention is to provide a batting practice machine having a remote control which may be used to vary the speed of the ball instantaneously between attempts by the user to hit the ball.

Another object of the invention is to provide a batting practice machine wherein the drive mechanism may be driven in the reverse direction when the ball is struck by a suer but wherein the drive mechanism provides a restoring force which brings the ball up to full speed in the forward direction in approximately four to five seconds after the ball is struck.

A still further object of the invention is to provide a batting practice machine which can be used by righthanders and lefthanders.

Other objects and advantages of the invention will become apparent from the following description and drawings wherein:

DETAILED DESCRIPTION OF THE DRAWINGS

Figures 1, 2:
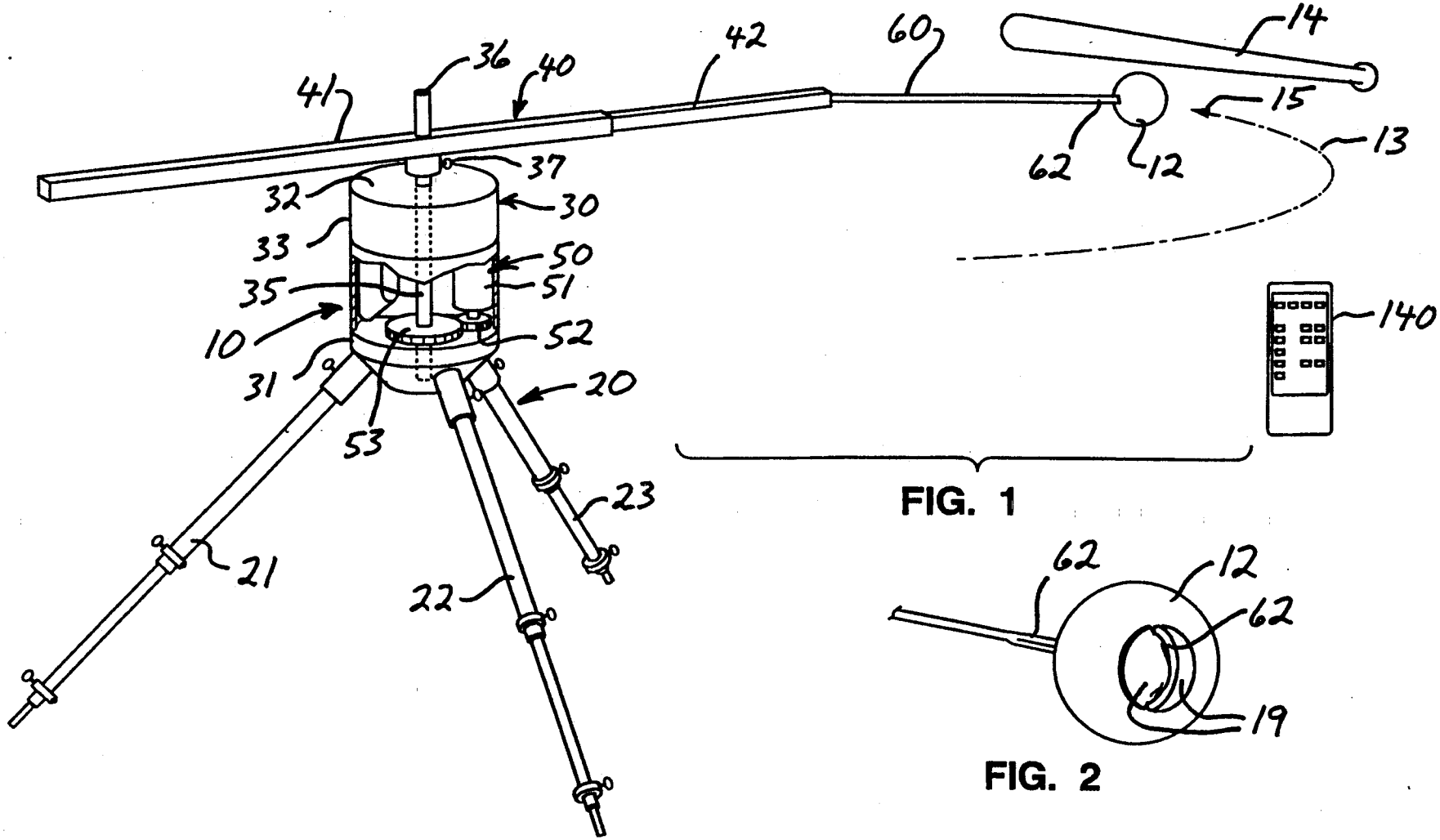
FIG. 1 is a perspective view of the apparatus according to the present invention.
FIG. 2 is a perspective view of a portion of the mechanism shown in FIG. 1.

As shown in FIG. 1, a portable and lightweight batting practice apparatus is shown generally as 10. The apparatus swings a ball 12 around a generally circular path 13 in a forward direction indicated by arrow 15. A user periodically swings a bat 14 (or a racket, not shown) in a direction directly opposite to the direction shown by arrow 15 and attempts to hit the ball 12.

A base means 20 is provided which utilizes three telescoping legs 21, 22 and 23. Legs 21, 22 and 23 may be raised or lowered to adjust the height of the path of the ball 12 relative to the height of a particular user. In addition, one or more of the telescoping legs may be lowered or raised to incline the path of the ball relative to a horizontal plane and to the user.

A housing 30 of generally cylindrical nature is carried by base 20. Housing 30 includes a base hub 31 which forms the lower portion of housing 30, a top 32 and side wall 33. A drive shaft 35 is carried by housing 30; the lower section of drive shaft 35 is mounted in two sealed bearings in base hub 31. Drive shaft 35 extends in a generally vertical direction. By "generally vertical" it is meant that shaft 35 may rotate about an axis which is inclined slightly away from the vertical if the telescoping legs 21, 22 and 23 are positioned to provide an incline in the circular path of the ball 12 relative to a horizontal plane. A rotatable arm means 40 is provided which includes a first elongated primary section 41 connected to drive shaft 35 and a secondary portion 42 carried by primary arm 41. Optional rubber shock mounts (not shown) may be utilized between drive shaft 35 and primary section 41 to help absorb the shock of a hit. The top 36 of drive shaft 35 extends upwardly a sufficient distance to allow for vertical adjustment of arm means 40 on shaft by set screw 37.

A cord means 60 is provided having a proximal end (not shown) which extends into secondary arm 42 about 6 inches and is attached to arm 42 by a clevis. Cord means 60 also has a distal end 62 attached to ball 12. The distal end 62 of cord means 60 is nylon but may be a resilient, elastic cord, which stretches when the ball 12 is hit by the bat 14.

As shown in FIG. 2, the distal end 62 of cord means 60 passes through ball 12. A concave recess 19 is formed in the surface of ball 12 so that the portion of cord 62, which extends across recess 19, does not project beyond the outer surface of ball 12. A metallic or plastic cap may be carried in recess 19 to prevent cord 60 from cutting into ball 12.

Different types of balls may be used. For example, regulation baseballs, softballs, tennis balls and other balls may be used. The use of an optional elastic portion at the distal end 62 allows the elastic portion of the cord to stretch and to absorb a portion of the force transmitted to the ball 12 by the stroke of the bat 14. The distal end of secondary arm 42 provides a guide for the cord to reduce any tangling of the cord means 60 which might otherwise be caused after the ball is hit.

A drive means 50 is carried by the base hub portion 31 of housing 30. Drive means 50 includes a reversible DC motor 51 and a gear drive including gear 52 carried by the shaft of motor 51 and gear 53 carried by drive shaft 35. As shown in FIG. 1, the arrow 15 represents the forward direction of rotation of ball 12 when the apparatus is used by a righthander. When the ball 12 is struck sharply in the opposite direction to that shown by arrow 15, rotatable arm means 40 is forcibly driven in the reverse direction, as is the drive shaft and gear drive, as well as DC motor 51. However, DC motor 51 tends to resist motion in the reverse direction and, when DC motor 51 overcomes the motion in the reverse direction, it immediately resumes driving said gear drive and drive shaft in the forward direction to again present ball 12 along the circular path 13 in the forward direction shown by arrow 15. I have found an acceptable motor manufactured by Howard Industries and available through Minarik in Santa Clara, Calif. The motor is Model No. 760-980143. This motor has approximately 0.05 horsepower, may be stalled and driven backwards in ordinary use and which has a restoring force which tends to return ball 12 to rotation in the forward direction. As a practical mater, this motor is able to return ball 12 to full speed in a forward direction within four to five seconds after the ball is struck.

Figure 3:
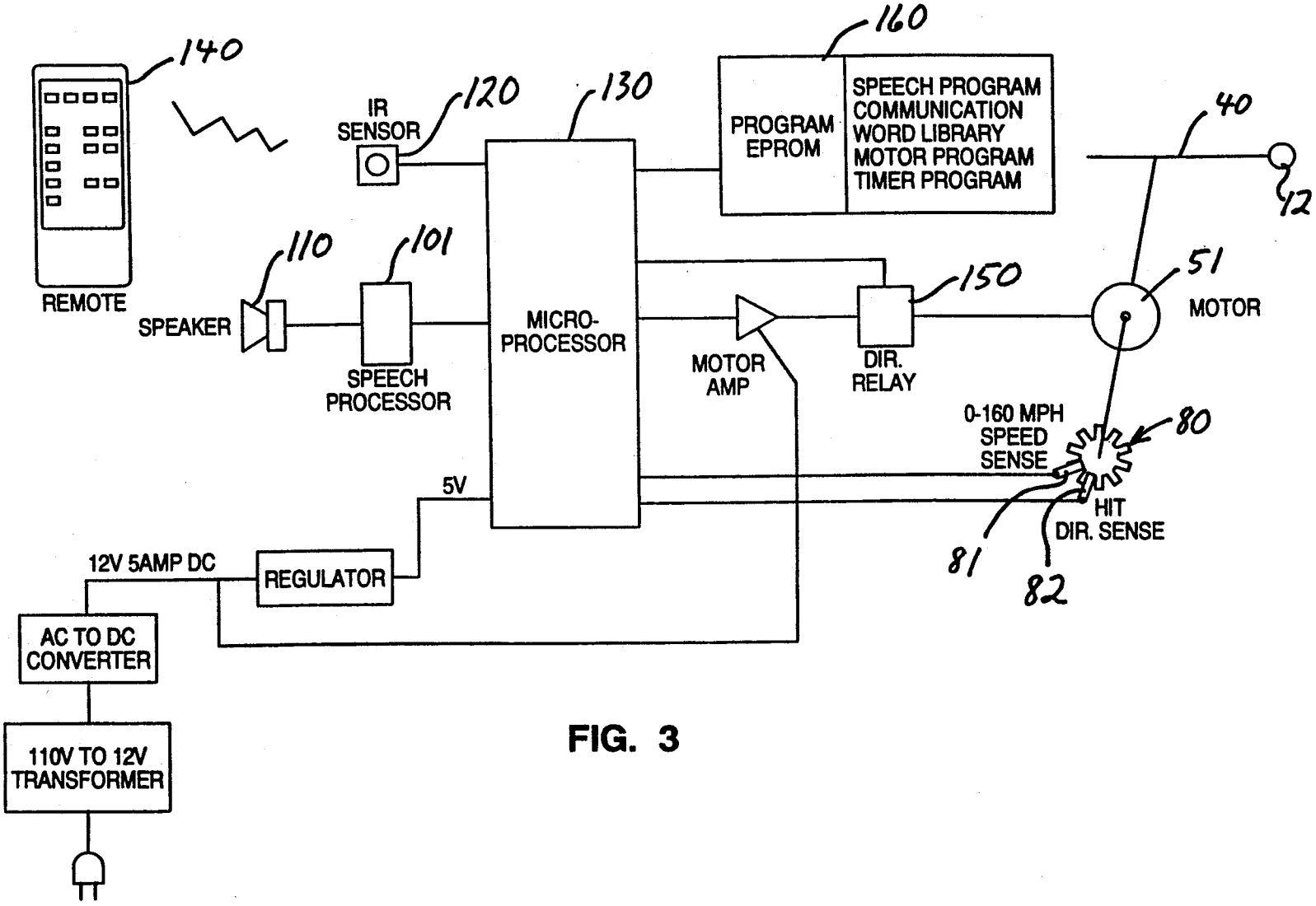
FIG. 3 is a schematic representation of the controls and processors used in conjunction with the invention.
Figure 4:
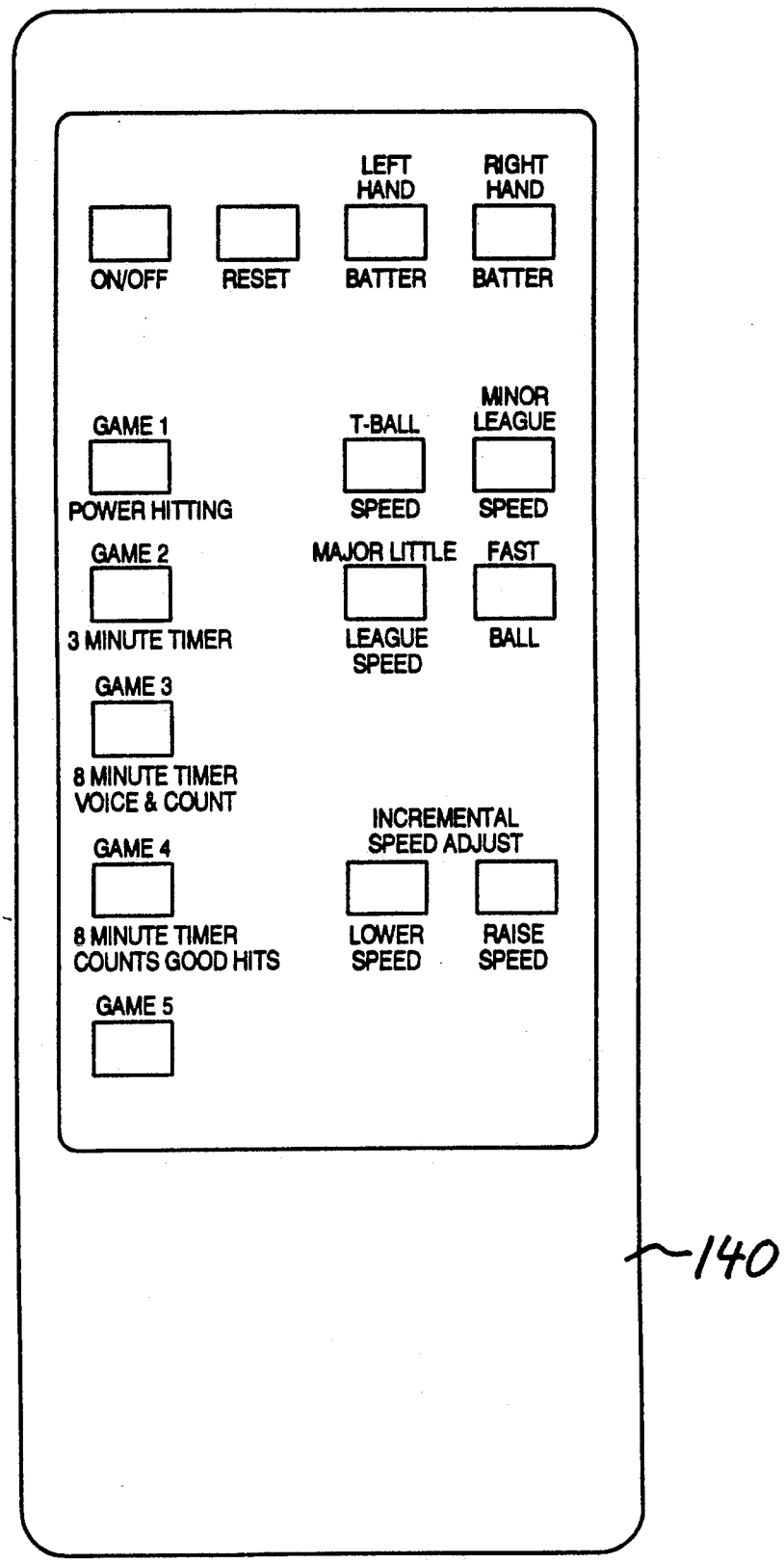
FIG. 4 is a representation of the remote control handheld unit which is used in conjunction with the invention.

As shown schematically in FIG. 3, the shaft of motor 51 is fitted with a slotted wheel 80. The outer edge of the slotted wheel passes between two optical sensors 81 and 82. Sensors 81 and 82 are commercially available from Harris Semiconductor and are known as "Interrupter Modules." The sensors are mounted so that, as the edge of an open slot begins to pass through the first sensor, the edge of a closed slot has just passed the second sensor. If the motor is supposed to be turning clockwise, for example, the instant the left edge of an open slot begins to pass the first sensor, an interrupt is generated. It is known that at that moment, a closed slot will be passing under the second sensor. The interrupt triggered by the first sensor tests the state of the second sensor and compares it with the software flag. For example, if the second sensor is seeing a closed slot, the ball is still moving in the forward direction. Assuming that the batter has struck the ball and reversed the motor direction, the interrupt will be triggered by the right edge of the slot and the second sensor will see an open slot indicating the motor is turning in the reverse direction. Sensor 81 is also used as a speed sensor for sensing the speed in both the forward and reverse directions. The greater the strength of the blow to the ball, the greater the speed of the slotted wheel 80 in the reverse direction.

The schematic diagram shown in FIG. 3 indicates the general control circuitry used in conjunction with the batting machine according to this invention. The machine can be powered by either conventional 110 volt AC, or by a 12 volt battery, which allows the machine to be used in remote fields. Motor 51 and ball 12 are shown, and the speed sensor 81 and direction sensor 82 are shown carried by the shaft of motor 51. The speed and direction sensors interact with microprocessor 130, program EPROM 160 (a Texas Instrument "M" series) and speech processor means 101 for selecting an appropriate spoken message to play immediately for the user after the ball has been struck. For example, if the batter strikes the ball and the sensors 81 and 82 indicate a reverse speed of 160 mph, the speech processor means 101 will select the message "home run" (or other appropriate message), which will be transmitted immediately to speaker means 110 for immediate audio feedback for the user. An acceptable voice chip for use as speech processor 101 is Texas Instrument TSP53C30 which may be used in conjunction with an Intel 8051 microprocessor. An acceptable commercially available speech program is "Words" from Texas Instruments.

An infrared sensor 120 (a Sharp ISU 61L) is utilized in conjunction with the microprocessor 130 to facilitate the use of a handheld remote control unit 140 (a 28 key pad from Presentation Electronics). The remote control unit 140 may be used to vary the speed of the pitches as well as to reverse the rotation of arm means 40 by switching the directional relay 150 for use by left-handed batters. Alternately, various menus may be programmed to provide pitches over a given period of time for any given batter. The programs may vary depending on the age and experience of the users. For example, an eight minute practice session may be programmed in which one batter will attempt to hit as many pitches as possible. The player (or coach) may vary the speed of the pitches, if desired, during this eight minute period.

What is claimed is:

1. In a batting practice apparatus wherein a ball is carried by a rotatable arm and is swung around a generally circular path in a forward direction, and a user periodically swings a bat or racket in an attempt to hit said ball, and when the user hits said ball arm and ball are driven in the opposite direction, the improvement comprising:

drive means including a reversible DC motor, said motor having a drive shaft free to rotate in a forward or reverse direction, said shaft being connected to said arm and when energized by said motor to rotate in either said forward or reverse direction will temporarily rotate in the opposite direction solely in response to said ball being hit in said opposite direction optical sensing means comprising a slotted wheel carried by said motor and an optical sensor for detecting when said shaft is rotating in said opposite direction and for measuring the speed of said opposite rotation, speech processor means responsive to said sensing means for selecting one of several prerecorded audio messages, said message being selected based upon the measured speed of said shaft in, said opposite direction, and speaker means to broadcasting said audio message for said user.

2. The apparatus of claim 1 further comprising a battery power means whereby said apparatus may be used in a location away from conventional electric power supply.

3. The apparatus of claim 1 further comprising a handheld remote control means for controlling the speed of said motor.

* * * * *

UNITED STATES PATENT AND TRADEMARK OFFICE

CERTIFICATE OF CORRECTION

PATENT NO. : 5,275,396
DATED : January 4, 1994
INVENTOR(S) : Michael T. Sudia

It is certified that error appears in the above-indentified patent and that said Letters Patent is hereby corrected as shown below:

On the Title page, item [57], col. 2, line 10, the first "and" should be deleted.

Column 1, line 55, "suer" should be --user--.

Column 4, line 33, after "said ball" (second occurrence) insert --, said-- before "arm".

Column 4, line 51, the comma should be removed after "in"

Signed and Sealed this

Twenty-eighth Day of June, 1994

*Attest:*

Bruce Lehman

BRUCE LEHMAN

*Attesting Officer*

*Commissioner of Patents and Trademarks*